US006959661B2

(12) United States Patent
Nakajima et al.

(10) Patent No.: US 6,959,661 B2
(45) Date of Patent: Nov. 1, 2005

(54) STEERING DEVICE FOR PERSONAL WATERCRAFT

(75) Inventors: Jun Nakajima, Saitama (JP); Tomohiro Fuse, Saitama (JP); Tadaaki Nagata, Saitama (JP); Jo Yoshida, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,029

(22) Filed: Oct. 29, 2002

(65) Prior Publication Data

US 2003/0136321 A1 Jul. 24, 2003

(30) Foreign Application Priority Data

Oct. 30, 2001 (JP) ..... 2001-333302

(51) Int. Cl.[7] ..... B63H 25/00
(52) U.S. Cl. ..... 114/144 R; 114/55.57
(58) Field of Search ..... 114/55.5, 55.52, 114/55.53, 55.56, 55.57, 144 R, 154; 280/779; 74/492

(56) References Cited

U.S. PATENT DOCUMENTS 3,208,300 A * 9/1965 Morse ..... 74/498
4,244,316 A * 1/1981 Kulischenko ..... 114/144 R
4,589,679 A * 5/1986 Wackerle et al. ..... 280/777
4,726,311 A * 2/1988 Niina ..... 114/144 R
4,986,208 A * 1/1991 Kobayashi ..... 114/55.53
5,564,313 A * 10/1996 Hoblingre ..... 74/492
5,846,103 A * 12/1998 Varney et al. ..... 440/38
6,055,922 A * 5/2000 Madachi et al. ..... 114/144 R
6,062,154 A * 5/2000 Ito ..... 114/55.57
6,105,528 A * 8/2000 Kuroi et al. ..... 114/154
6,202,583 B1 * 3/2001 Asakura ..... 114/144 R
6,276,291 B1 * 8/2001 Lapointe et al. ..... 114/144 R

OTHER PUBLICATIONS

Patent Abstracts of Japan; Publication No. 11011395A, Jan. 19, 1999; "Steering Device for Small for Small–Sizes Ship".

* cited by examiner

*Primary Examiner*—Andrew D. Wright
(74) *Attorney, Agent, or Firm*—Birch, Stewart, Kolasch & Birch, LLP

(57) ABSTRACT

A steering device for a personal watercraft includes a handle holder fitted to a watercraft body. A steering shaft passes through the handle holder, and a handle is fitted to the upper end of the steering shaft. The steering shaft is provided with a groove, and a holding member is provided in the handle holder and is fitted into the groove. Accordingly, movement of the steering shaft in the axial direction is restricted. A flange or the groove has a shape such that its width can be reduced. When the holding member is fitted by setting the width to a small size, and taking dimensional variations into account, the chattering between the flange or the groove and the holding member can be reduced. In view of this, the steering shaft is provided with the flange or the groove, and the holding member provided in the handle holder is fitted to the flange or the groove, so that movement of the steering shaft in the axial direction can be restrained. As a result, a steering device enhanced in feeling during operation can be realized.

25 Claims, 8 Drawing Sheets

STEERING DEVICE FOR PERSONAL WATERCRAFT

CROSS-REFERENCE TO RELATED APPLICATIONS

This nonprovisional application claims priority under 35 U.S.C. § 119(a) on Patent Application No. 2001-333302 filed in Japan on Oct. 30, 2001, the entirety of which is hereby incorporated by reference.

BACKGROUND OF THE INVENTION

1. Field of the Invention

The present invention relates to a steering device for a personal watercraft, which includes a handle holder fitted to the watercraft body. A steering shaft passes through the handle holder, and a handle is fitted to the upper end of the steering shaft.

2. Description of Background Art

A steering device for a personal watercraft is disclosed in, for example, Japanese Patent Laid-open No. 11-11395, entitled "STEERING DEVICE FOR PERSONAL WATERCRAFT."

Referring to FIGS. 3 and 5 of the above publication, the above-mentioned technology resides in that a steering handle 22 is fitted to a steering shaft 21. The steering shaft 21 is inserted into a cylindrical body 20. The cylindrical body 20 is clamped between a flange 21 a provided on the steering shaft 21 and a C clip 45 for engaging with the steering shaft 21. The steering shaft 21 is rotatably fitted to the cylindrical body 20.

In the above-mentioned steering device for a personal watercraft, the cylindrical body 20 and the steering shaft 21 are formed of resin to obtain a reduction in weight or to prevent corrosion. Generally, resin-made component parts are inferior to metal-made component parts in dimensional accuracy.

The above-mentioned steering device for a personal watercraft has a structure in which the cylindrical body 20 has a large span and has a dispersion of dimensions. The cylindrical body 20 is clamped between the flange 21*a* of the steering shaft 21 and the C clip 45 of the steering shaft 21. Namely, in the structure in which a portion between upper and lower portions of the cylindrical body 20 (hereinafter referred to as "handle holder") is nipped, there is dispersion of the dimensions of the steering shaft 21. Accordingly, the chattering of the steering shaft in the axial direction is large.

In the steering device for a personal watercraft including resin-made component parts, it is desired to obtain a technology by which the chattering of the steering shaft in the axial direction can be reduced.

SUMMARY OF THE INVENTION

Accordingly, it is an object of the present invention to provide a steering device for a personal watercraft in which the chattering of a steering shaft in the axial direction is low and operation feeling is enhanced.

To attain the above object, according to a first aspect of the present invention, a steering device for a personal watercraft includes a handle holder fitted to the watercraft body. The steering shaft passes through the handle holder, and a handle is fitted to the upper end of the steering shaft. The steering shaft is provided with a flange or a groove, and a holding member provided in the handle holder is fitted to the flange or the groove. Accordingly, movement of the steering shaft in the axial direction is restricted.

In the steering device for a personal watercraft including resin-made component parts, it is preferable that the chattering of the steering shaft in the axial direction be low.

In view of this, a structure is provided in which the steering shaft is provided with the flange or the groove, the holding member is fitted to the flange or the groove, and the holding member is fitted to the handle holder.

The flange or the groove has such a shape that the width thereof can be set to a small size. Furthermore, by positioning the one flange or groove set small in width by the holding member, the chattering of the steering shaft in the axial direction can be reduced.

By providing the steering shaft with the flange or the groove and fitting the holding member provided in the handle holder to the flange or the groove, movement of the steering shaft in the axial direction can be restrained. As a result, a steering device enhanced in feeling during operation can be realized.

According to a second aspect of the present invention, the holding member is a U-shaped member.

With the holding member being a U-shaped member, it is easy to fit the holding member to the flange or the groove of the steering shaft. As a result, enhancement of assembly of the steering device can be obtained.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
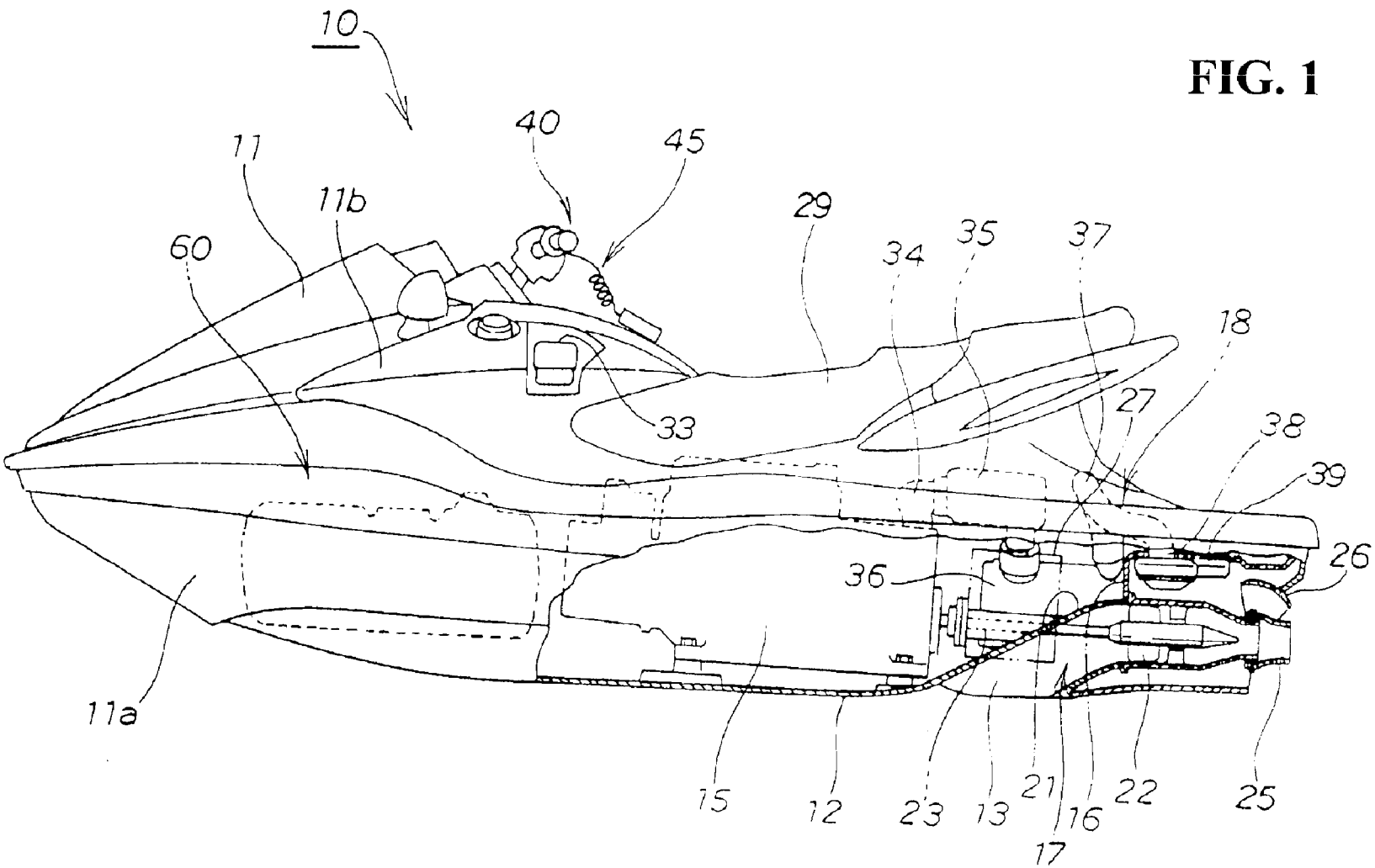
FIG. 1 is a side view of a personal watercraft on which a steering device according to the present invention is mounted.

An embodiment of the present invention will now be described with reference to the accompanying drawings.

The drawings should be viewed in the direction of orientation of the reference numerals.

FIG. 1 is a side view of a personal watercraft on which a steering device according to the present invention is mounted. The personal watercraft 10 includes a fuel tank 60 fitted to a front portion 11*a* of a watercraft body 11. An engine 15 is provided on the rear side of the fuel tank 60. A pump chamber 16 is provided on the rear side of the engine 15. A jet propeller 17 is provided in the pump chamber 16. An exhaust unit 18 has an intake side fitted to the engine 15 and an exhaust side fitted to the pump chamber 16. A steering device 40 is fitted on the upper side of the fuel tank 14. Furthermore, a seat 29 fitted on the rear side of the steering device 40.

The jet propeller 17 includes a housing 21 extending rearwards from an opening 13 in a watercraft bottom 12. An impeller 22 is rotatably fitted in the housing 21. Furthermore, the impeller 22 is connected to a drive shaft 23 of the engine 15.

According to the jet propeller 17, by driving the engine 15 to rotate the impeller 22, water sucked in through the opening 13 of the watercraft bottom 12 can be jetted toward the rear side of the watercraft body 11 from a steering pipe 25 through a rear end opening of the housing 21. The steering pipe 25 is a member fitted to the rear end of the housing 21 so that it can be swung in the left and right directions. A steering nozzle is provided for controlling the steering direction of the watercraft body 11 by being swung to the left and right directions by operations of the steering device 40.

The personal watercraft 10 is a jet propulsion watercraft, which has fuel supplied from the fuel tank 60 to the engine 15 to drive the engine 15. A driving force of the engine 15 is transmitted through the drive shaft 23 to the impeller 22, to rotate the impeller 22, thereby sucking water in through the opening 13 of the watercraft bottom 12. The water thus sucked in is jetted from the steering pipe 25 through the rear end of the housing 21, whereby the watercraft is propelled.

In FIG. 1, reference numeral 11*b* identifies a deck constituting an upper portion of the watercraft body 11, 26 identifies a reverse bucket made to cover the steering pipe 25 to cause a jet water flow to flow skewed forwardly downwards at the time of propelling the watercraft backwards, 27 identifies a battery as a power source for the watercraft body 11, 33 identifies an operating knob for operating the reverse bucket 26, 34 identifies an exhaust pipe, 35 identifies an exhaust body, 36 identifies a water muffler, 37 identifies a water lock pipe, 38 identifies a tail pipe, and 39 identifies a resonator.

Figure 2:
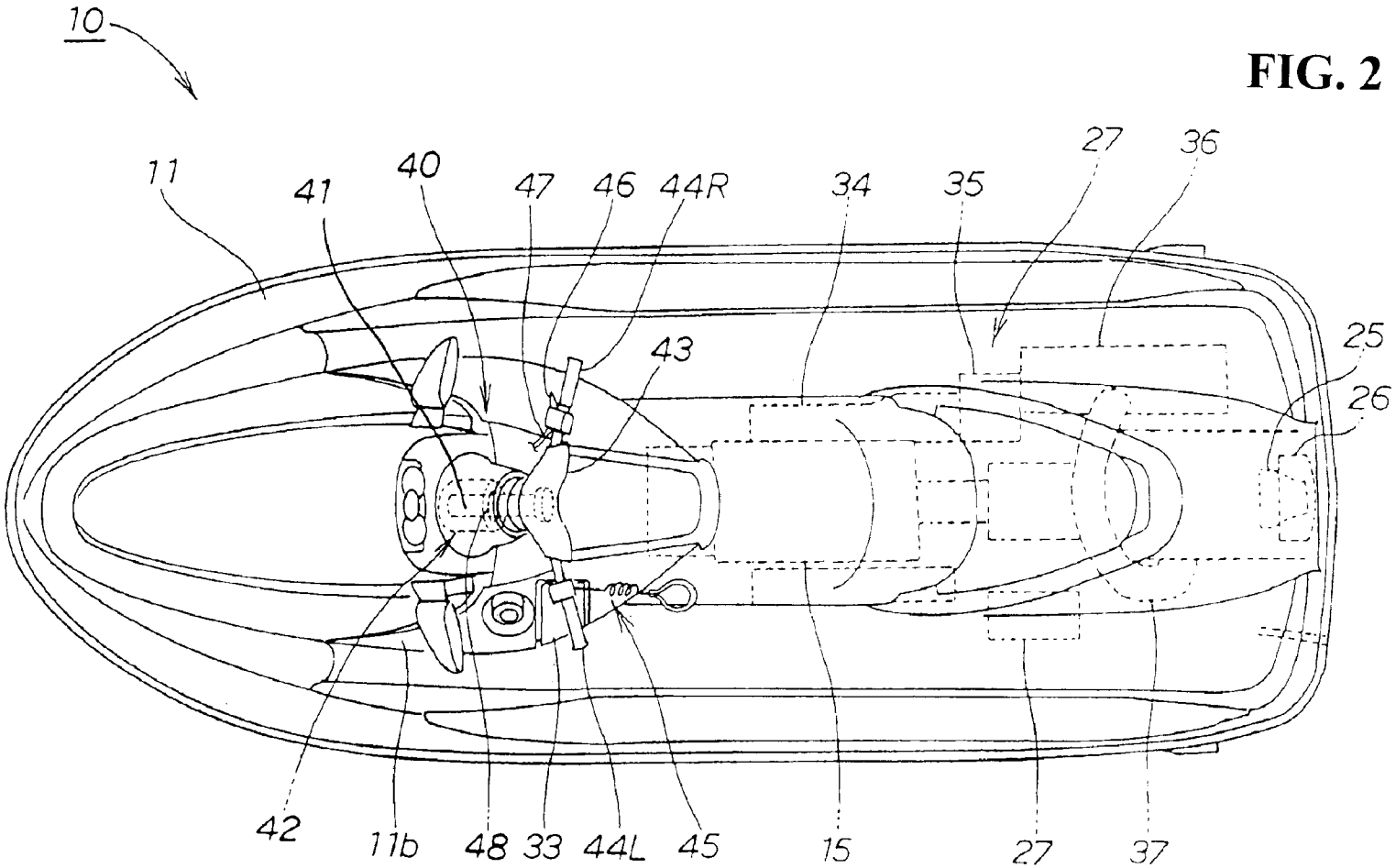
FIG. 2 is a plan view of the personal watercraft on which the steering device according to the present invention is mounted.

FIG. 2 is a plan view of the personal watercraft on which the steering device according to the present invention is mounted. The steering device 40 for the personal watercraft (hereinafter referred to simply as "the steering device 40") includes a steering shaft 41 rotatably fitted to the watercraft body 11. A handle holder 42 is rotatably fitted to the steering shaft 41. A handle 43 is fitted to the upper end of the steering shaft 41. Left and right handle grips 44L and 44R are fitted to left and right end portions of the handle 43. A main switch 45 is provided with a lanyard switch and is provided at a base portion of the left handle grip 44L. A throttle lever 46 is swingably fitted to a base portion of the right handle grip 44R. A throttle cable 47 extends from the throttle lever 46 to a throttle. Furthermore, a holding member 48 is provided for supporting the steering shaft 41 and holding the steering shaft 41 on the handle holder 42.

Figure 3:
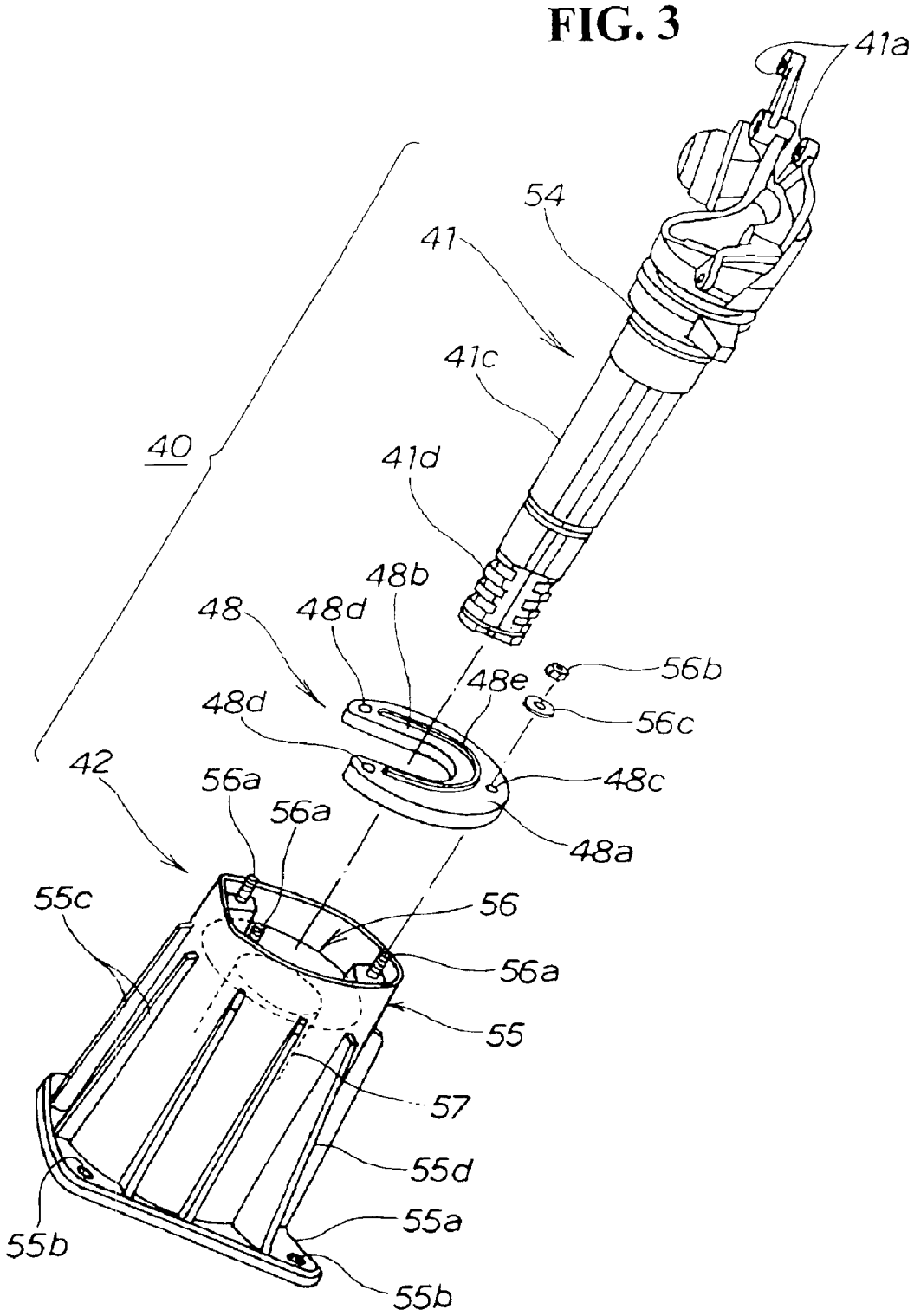
FIG. 3 is an exploded perspective view showing a major part of the steering device according to the present invention.

FIG. 3 is an exploded perspective view showing a major part of the steering device according to the present invention, and shows the steering shaft 41, the handle holder 42 and the holding member 48. The steering shaft 41 is a resin-made member, and includes a handle fitting portion 41*a* for receiving the handle 43, a groove 54 for receiving the holding member 48, a shaft portion 41*c* for being rotatably received in the handle holder 42, and a link fitting portion 41*d* for receiving a steering link (not shown).

The shaft portion 41*c* includes a straight upper portion, a tapered intermediate portion, and a straight lower portion. Accordingly, the shaft portion 41*c* conforms to the shape of a bearing portion 57 of the handle holder 42.

The handle holder 42 is a resin-made member, and includes a cylindrical portion 55 supported by the watercraft body 11 (See FIG. 1). A support portion 56 is provided at an upper portion of the cylindrical portion 55 to support the holding member 48. The bearing portion 57 extends downwards from the support portion 56 to rotatably support the shaft portion 41*c*.

The cylindrical portion 55 is provided with a flange 55*a* at a lower portion thereof to fit the watercraft body 11 (See FIG. 1). The flange 55*a* is provided with fitting holes 55*b*. The cylindrical portion 55 is provided on an outer periphery thereof with a plurality of ribs 55*c*, 55*d* (only one is shown) for enhancing rigidity.

The support portion 56 includes bolts 56*a* for fixing the holding member 48. In addition, symbols 56*b* denotes a nut screw-connected to the bolt 56*a* to thereby fix the holding member 48 to the handle holder 42. Reference numeral 56*c* denotes a washer provided intermediately between the bolt 56*a* and the nut 56*b*.

Figure 4:
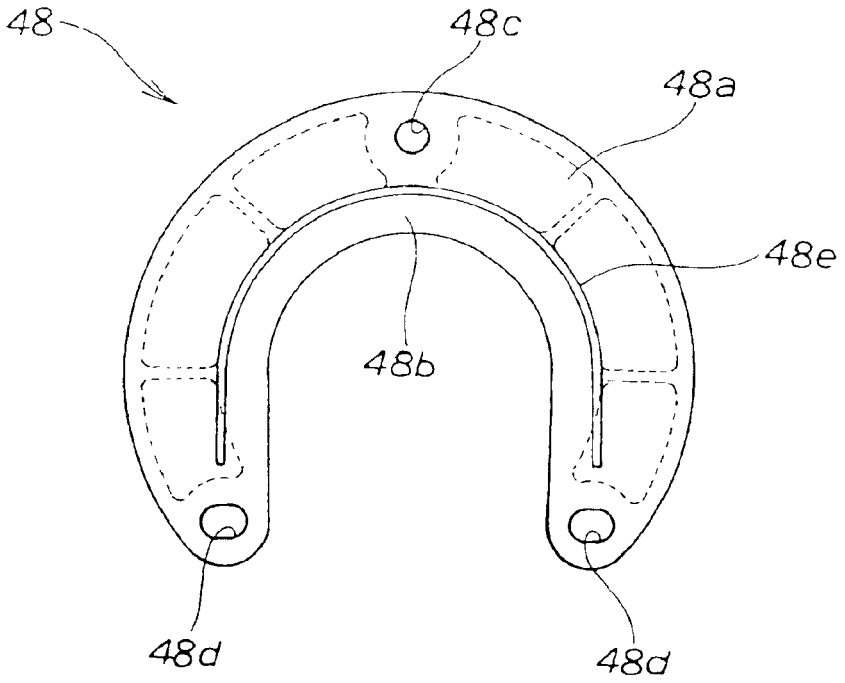
FIG. 4 is a plan view of a holding member of the steering device according to the present invention.

FIG. 4 is a plan view of the holding member of the steering device according of the present invention. The holding member 48 is a resin-made member which is U-shaped in plan view, and includes a main body portion 48*a*. A fitting portion 48*b* is provided in the main body portion 48*a* for fitting in the groove 54 (See FIG. 3) of the steering shaft 41 for rotatably supporting the steering shaft. Through-holes 48*c*, 48*c* and a through-hole 48*d* are provided for passing the bolts 56*a* (See FIG. 3) of the handle holder 42 therethrough. A rib 48*e* is provided for partitioning the main body portion 48*a* and the fitting portion 48*b* from each other.

The steering device 40 (See FIG. 3) has a structure in which the holding member 48 is a U-shaped member. With the holding member 48 being a U-shaped member, the holding member 48 can be easily fitted into the groove 54 (See FIG. 3) of the steering shaft 41. As a result, enhancement of assembly of the steering device 40 can be obtained.

Figure 5:
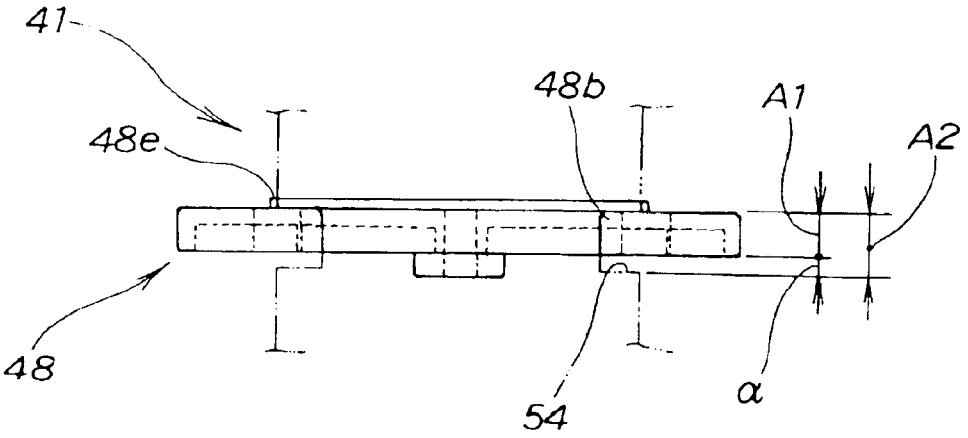
FIG. 5 is a front view of the holding member of the steering device according to the present invention.

FIG. 5 is a front view of the holding member of the steering device according to the present invention. The relationship of $A2=A1+\alpha$ is established, where A1 is the thickness of the fitting portion 48*b* of the holding member 48, A2 is the width of the groove 54 of the steering shaft 41, and $\alpha$ is the clearance between the groove 54 and the fitting portion 48*b*.

Generally, the thickness A1 of the fitting portion 48*b* may be set at a minimum size making it possible to maintain the rigidity of the holding member 48. The width A2 ($A2=A1+\alpha$) of the groove 54 for receiving the fitting portion 48*b* may be set small. Therefore, the chattering of the steering shaft 41 in the axial direction can be set small even in the case where the steering shaft 41 and the handle holder 42 (See FIG. 3) are resin-made products having a dispersion of dimensional accuracy.

Namely, the steering device 40 makes it possible to reduce the chattering of the steering shaft 41 in the axial direction, as compared with, for example, the structure in which a portion between upper and lower portions of the bearing portion of the handle holder is nipped.

Figure 6:
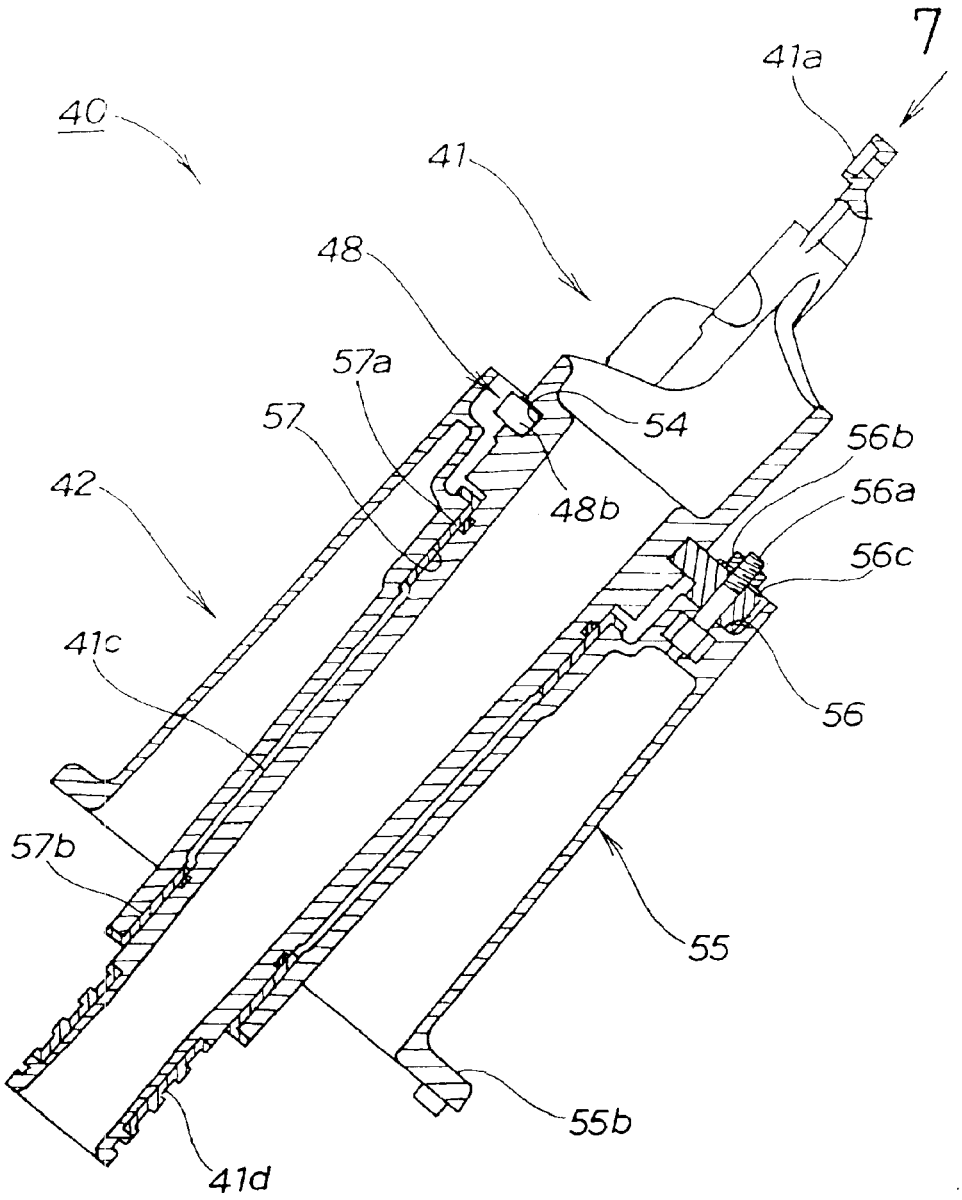
FIG. 6 is a side sectional view of the steering device for the personal watercraft according to the present invention.

FIG. 6 is a side sectional view of the steering device for the personal watercraft according to the present invention, and shows the assembled condition of the steering device 40. The steering device 40 is a steering device for a personal watercraft, which include the handle holder 42 fitted to the watercraft body 11 (See FIG. 1). The steering shaft 41 passes through the handle holder 42. The handle 43 (See FIG. 1) is fitted to the upper end of the steering shaft 41. The steering shaft 41 is provided with the groove 54, and the holding member 48 provided in the handle holder 42 is fitted into the groove 54. Accordingly, movement of the steering shaft 41 in the axial direction is restricted.

Incidentally, reference numeral 57*a* identifies an upper portion collar fitted to the upper end of the bearing portion 57, and 57*b* identifies a lower portion collar fitted to the lower end of the bearing portion 57.

Figure 7:
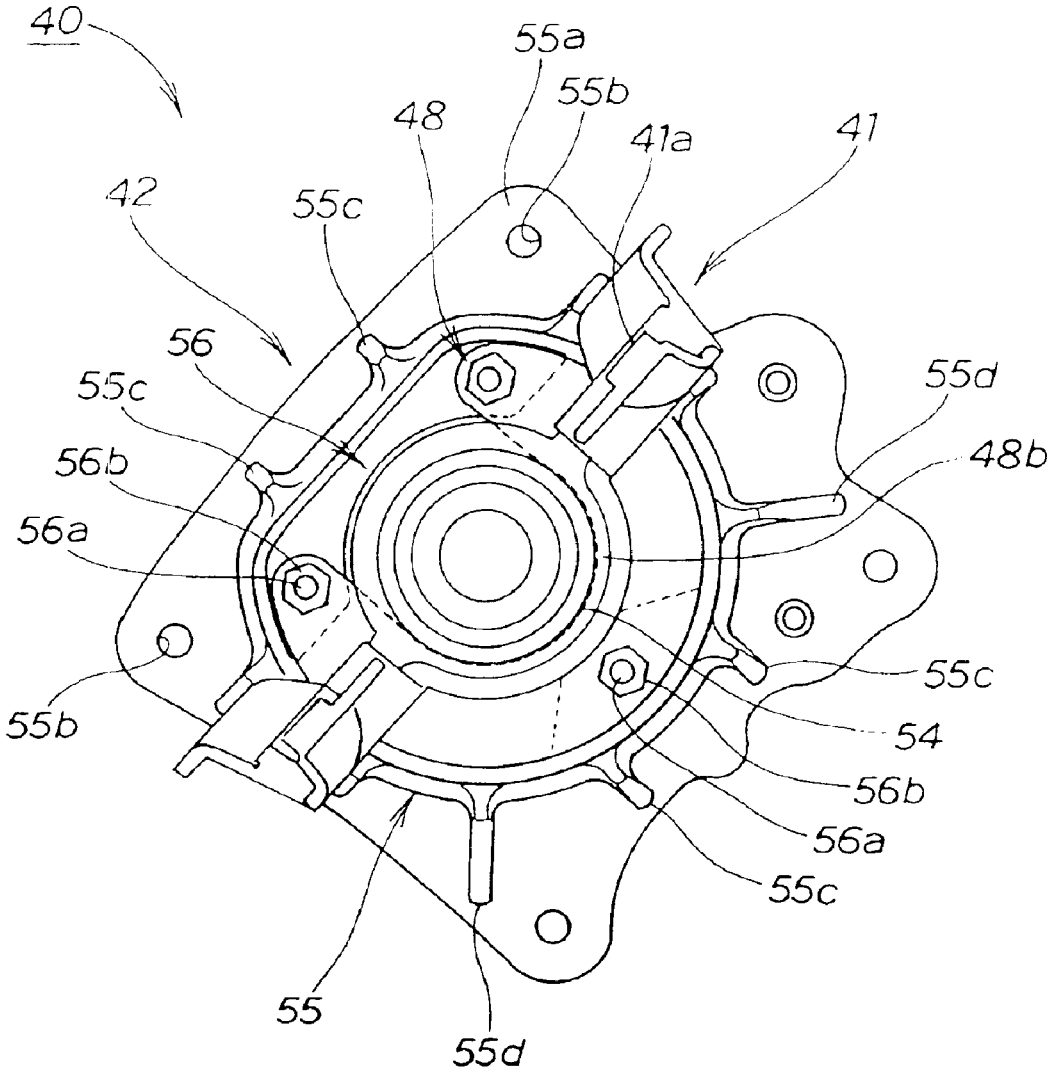
FIG. 7 is a view taken along arrow 7 of FIG. 6.

FIG. 7 is a view taken in the direction of arrow 7 of FIG. 6, and shows a plan sectional view of the steering device. Generally, in a steering device for a personal watercraft including resin-made component parts, it is preferable that the chattering of the steering shaft in the axial direction low.

In view of this, a structure is provided in which the steering shaft 41 is provided with the groove 54, the holding member 48 is fitted into the groove 54, and the handle holder 42 is fitted to the holding member 48.

As shown in FIG. 5, the groove 54 has such a shape that its width can be set small. By positioning the one groove 54 set to have a small width by the holding member 48, the chattering of the steering shaft 41 in the axial direction can be reduced. Namely, the steering shaft 41 is provided with the groove 54, and the holding member 48 provided in the handle holder 42 is fitted into the groove 54. Accordingly, movement of the steering shaft 41 in the axial direction can be restrained. As a result, a steering device 40 an enhanced feeling during operation can be realized.

Figures 8A, 8B, 8C:
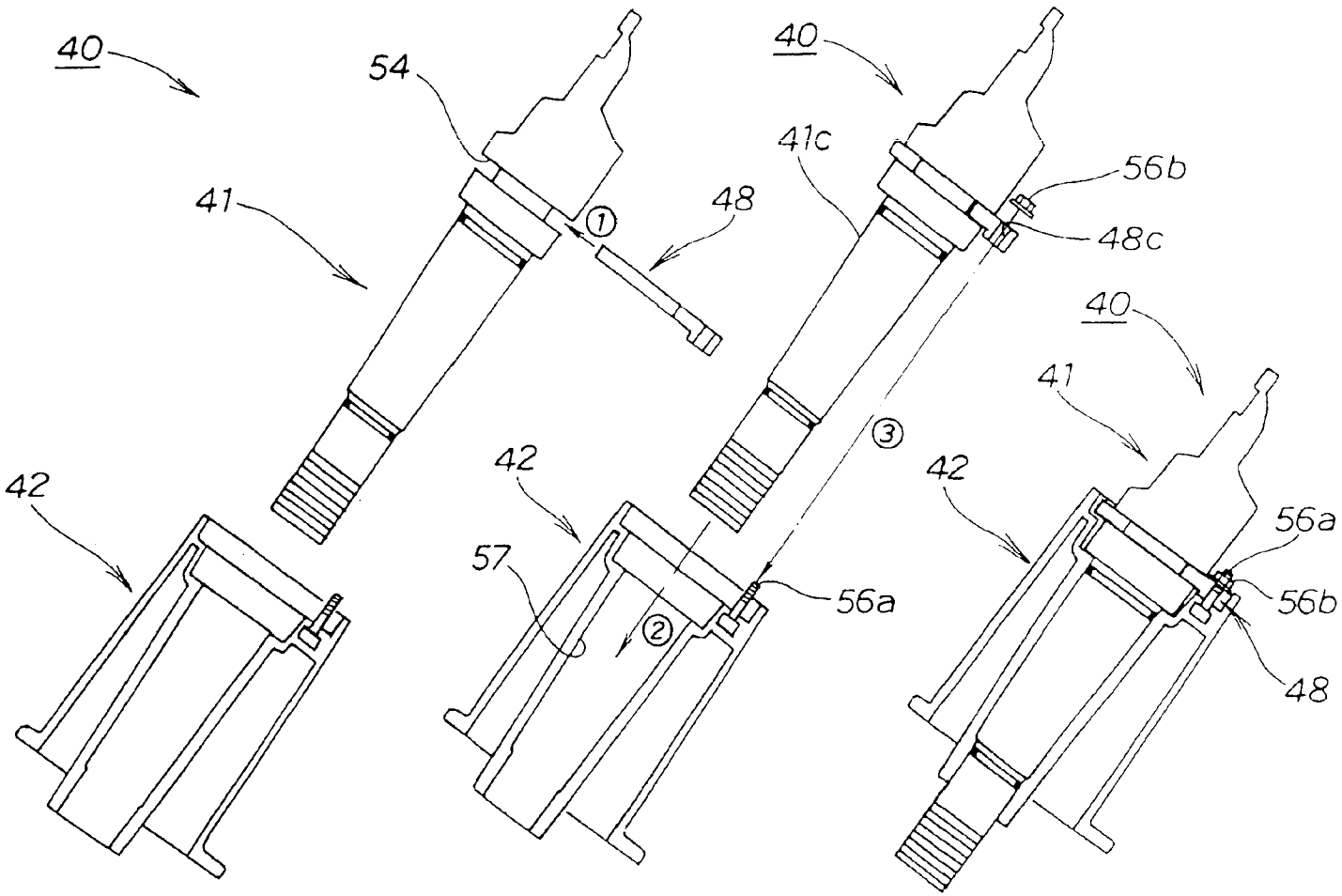
FIG. 8 is action illustrations of the steering device for the personal watercraft according to the present invention.

The operation of the steering device 40 as described above will now be described. FIGS. 8(*a*) to 8(*c*) are operation diagrams of the steering device for a personal watercraft according to the present invention. Specifically, FIGS. 8(*a*) to 8(*c*) show the procedure for assembling the steering device.

In FIG. 8(*a*), the holding member 48 is fitted into the groove 54 of the steering shaft 41 as indicated by arrow ①. In FIG. 8(*b*), the shaft portion 41*c* of the steering shaft 41 is inserted into the bearing portion 57 of the handle holder 42 as indicated by arrow ②. The bolt 56*a* is passed through the through-hole 48*c* of the holding member 48 as indicated by arrow ③. Furthermore, the steering shaft 41 and the holding member 48 are set into the handle holder 42. In FIG. 8(*c*), the nut 56*b* is fitted to the bolt 56*a*, and the steering shaft 41 is rotatably fitted to the handle holder 42 through the holding member 48.

Figure 9:
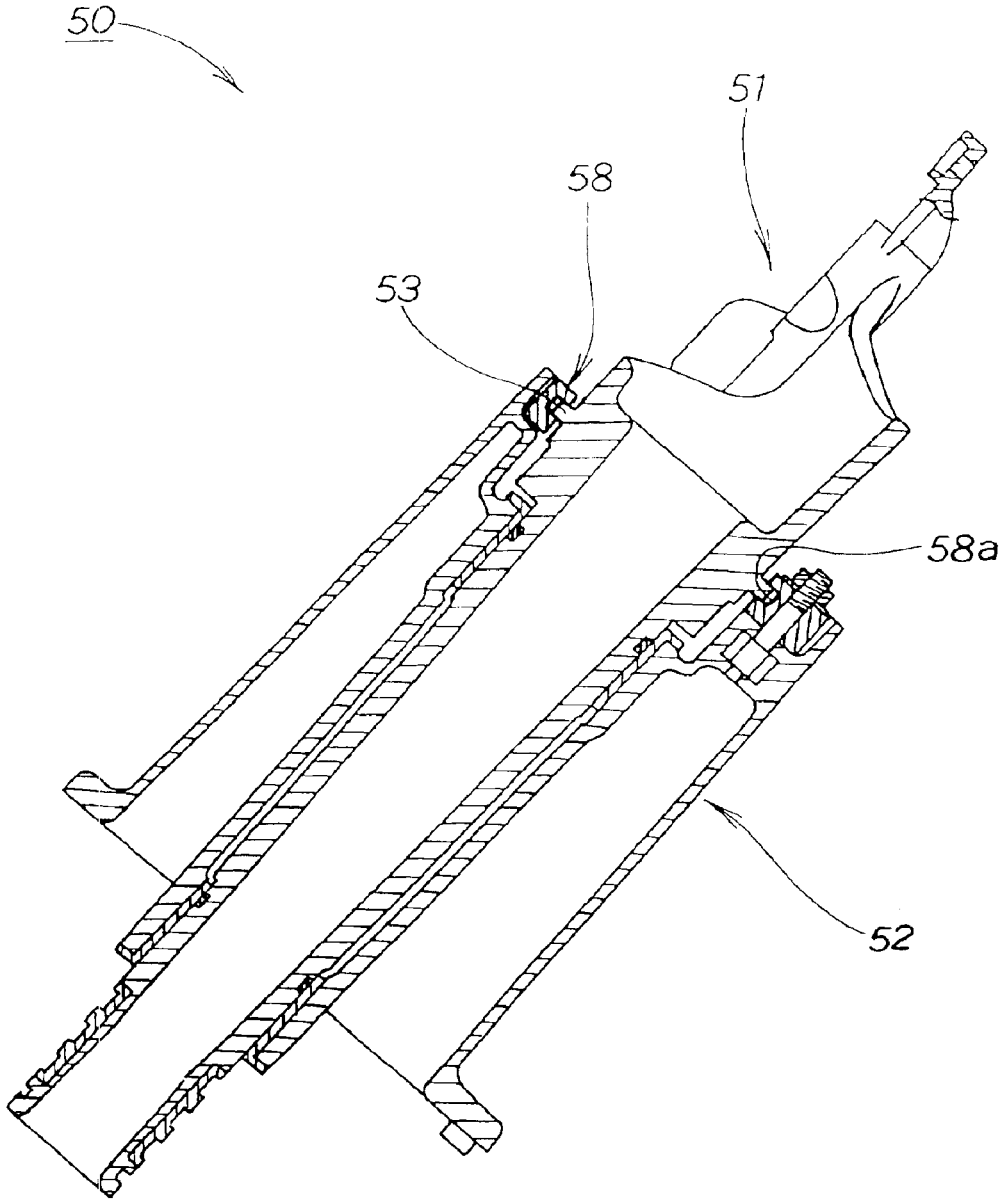
FIG. 9 is a side sectional view of a steering device for a personal watercraft according to a second embodiment of the present invention.

FIG. 9 is a side sectional view of a steering device for a personal watercraft according to a second embodiment of the present invention, in which the same component parts as those in the steering device 40 (See FIG. 6) are denoted by the same reference numerals. Accordingly, a detailed description thereof is omitted.

The steering device 50 is a steering device for a personal watercraft including a handle holder 52 fitted to a watercraft body 11 (See FIG. 1). A steering shaft 51 passes through the handle holder 52, and a handle 43 (See FIG. 1) is fitted to the upper end of the steering shaft 51. The steering shaft 51 is provided with a flange 53, and a holding member 58 provided in the handle holder 52 is fitted to the flange 53. Accordingly, movement of the steering shaft 51 in the axial direction is restricted. Reference numeral 58*a* identifies a recessed portion provided in the holding member 58 for fitting the flange 53 therein.

The steering shaft 51 is provided with the flange 53, the holding member 58 is fitted to the flange 53, and the holding member 58 is fitted to the handle holder 52. By providing the steering shaft 51 with the flange 53 and fitting the holding member 58 provided in the handle holder 52 to the flange 53, movement of the steering shaft 51 in the axial direction can be restrained. As a result, a steering device 50 enhanced in feeling during operation can be realized.

In addition, the holding member 58 is a U-shaped member. In the same manner as the holding member 48 shown in FIG. 4, and, with the holding member 58 made to be a U-shaped member, it is easy to fit the holding member 58 to the flange 53 of the steering shaft 51. As a result, enhancement of assembly of the steering device 50 can be obtained.

While the steering shaft 41, the handle holder 42 and the holding member 48 have been resin-made component parts as shown in FIG. 1 in the above embodiment, this is not limitative. The steering shaft, the handle holder and the holding member may be metallic component parts, and may be selected appropriately from metallic component parts and resin-made component parts.

The present invention, constituted as above, displays the following effects.

The flange or the groove has such a shape that its width can be set small. When the holding member is fitted by setting the width small and taking dimensional variations into account, the chattering between the flange or the groove and the holding member can be reduced.

According to the first aspect of the present invention, the steering shaft is provided with the flange or the groove, and the holding member provided in the handle holder is fitted to the flange or the groove. Accordingly, movement of the steering shaft in the axial direction can be restrained. As a result, a steering device enhanced in feeling during operation can be realized.

According to the second aspect of the present invention, the holding member is a U-shaped member, so that it is easy to fit the holding member to the flange or the groove of the steering shaft. As a result, enhancement of assembly of the steering device can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A steering device for a personal watercraft, comprising:

a handle holder mountable to a watercraft body, said handle holder including a holding member attached thereto by a fastener, said holding member being a unitary, one piece structure;

a steering shaft passing through said handle holder, said steering shaft including a flange or a groove; and a handle mounted to an upper end of said steering shaft, wherein said holding member is fitted on said flange or received in said groove of said steering shaft, whereby movement of said steering shaft in the axial direction is restricted.

2. The steering device for a personal watercraft according to claim 1, wherein said holding member is a U-shaped member.

3. The steering device for a personal watercraft according to claim 1, wherein said steering shaft is made of a resin material.

4. The steering device for a personal watercraft according to claim 1, wherein said steering shaft includes a handle fitting portion for receiving said handle, a groove for receiving said holding member, a shaft portion for being rotatably received in said handle holder, and a link fitting portion for receiving a steering link of the personal watercraft.

5. The steering device for a personal watercraft according to claim 4, wherein said shaft portion includes a straight upper portion, a tapered intermediate portion, and a straight lower portion, and said handle holder includes a bearing portion having a straight upper portion, a tapered intermediate portion and a straight lower portion for respectively receiving said straight upper portion, said tapered intermediate portion and said straight lower portion of said shaft portion.

6. The steering device for a personal watercraft according to claim 1, wherein said handle holder includes a cylindrical portion mountable to the watercraft body, a support portion provided at an upper portion of said cylindrical portion to support said holding member, and a bearing portion extending downwards from said support portion to rotatably support said steering shaft.

7. The steering device for a personal watercraft according to claim 1, wherein said holding member includes a main body portion, and a fitting portion provided in said main body portion for being fitting with said flange or groove of said steering shaft for rotatably supporting said steering shaft.

8. The steering device for a personal watercraft according to claim 7, wherein said steering shaft includes a groove, and wherein the relationship of $A2=A1+\alpha$ is established, where A1 is a thickness of said filling portion of said holding member, A2 is a width of said groove of said steering shaft, and a is a clearance between said groove and said fitting portion.

9. A personal watercraft, comprising:

a watercraft body;

an engine;

a jet propeller for propelling said watercraft body, said jet propeller including an impeller driven by a drive shaft of said engine;

a steering nozzle, said steering nozzle being mounted to swing in left and right directions to steer said watercraft body;

a steering device, said steering device being operably connected to said steering nozzle for swinging said steering nozzle, said steering device including:

a handle holder, said handle holder being mounted to said watercraft body, said handle holder including a holding member attached thereto by a fastener, said holding member being a unitary, one piece structure;

a steering shaft passing through said handle holder, said steering shaft including a flange or a groove; and a handle mounted to an upper end of said steering shaft, wherein said holding member is fitted on said flange or received in said groove of said steering shaft, whereby movement of said steering shaft in the axial direction is restricted.

10. The personal watercraft according to claim 9, wherein said holding member is a U-shaped member.

11. The personal watercraft according to claim 9, wherein said steering shaft is made of a resin material.

12. The personal watercraft according to claim 9, wherein said steering shaft includes a handle fitting portion for receiving said handle, a groove for receiving said holding member, a shaft portion for being rotatably received in said handle holder, and a link fitting portion for receiving a steering link of the personal watercraft.

13. The personal watercraft according to claim 12, wherein said shaft portion includes a straight upper portion, a tapered intermediate portion, and a straight lower portion, and said handle holder includes a bearing portion having a straight upper portion, a tapered intermediate portion and a straight lower portion for respectively receiving said straight upper portion, said tapered intermediate portion and said straight lower portion of said shaft portion.

14. The personal watercraft according to claim 9, wherein said handle holder includes a cylindrical portion mountable to the watercraft body, a support portion provided at an upper portion of said cylindrical portion to support said holding member, and a bearing portion extending downwards from said support portion to rotatably support said steering shaft.

15. The personal watercraft according to claim 9, wherein said holding member includes a main body portion, and a fitting portion provided in said main body portion for being fitting with said flange or groove of said steering shaft for rotatably supporting said steering shaft.

16. The personal watercraft according to claim 15, wherein said steering shaft includes a groove, and wherein the relationship of $A2=A1+\alpha$ is established, where A1 is a thickness of said fitting portion of said holding member, A2 is a width of said groove of said steering shaft, and $\alpha$ is a clearance between said groove and said fitting portion.

17. The steering device according to claim 1, wherein said holding member is located at an upper portion of said handle holder.

18. The personal watercraft according to claim 9, wherein said holding member is located at an upper portion of said handle holder.

19. The steering device according to claim 1, wherein the flange or groove of said steering shaft is a groove, said holding member including a fitting portion receivable in the groove.

20. The personal watercraft according to claim 9, wherein the flange or groove of said steering shaft is a flange, said holding member including a groove formed therein for receiving said flange.

21. A steering device for a personal watercraft, comprising:

a handle holder mountable to a watercraft body, said handle holder including a holding member;

a steering shaft passing through said handle holder, said steering shaft including a flange or a groove and a shaft portion for being rotatably received in said handle holder, said shaft portion including a straight upper portion, a tapered intermediate portion, and a straight lower portion; and a handle mounted to an upper end of said steering shaft, wherein said holding member is fitted to said groove of said steering shaft, whereby movement of said steering shaft in the axial direction is restricted, and wherein said handle holder includes a bearing portion having a straight upper portion, a tapered intermediate portion and a straight lower portion for respectively receiving said straight upper portion, said tapered intermediate portion and said straight lower portion of said shaft portion.

22. The steering device for a personal watercraft according to claim 1, wherein the flange or groove of said steering shaft is a groove, said holding member including a groove formed therein for receiving said flange.

23. The steering device for a personal watercraft according to claim 1, wherein said holding member includes a main body portion, a fitting portion and a rib separating said main body portion and said fitting portion, said main body portion including at least one through hole formed therein for receiving the fastener.

24. The personal watercraft according to claim 9, wherein said holding member includes a main body portion, a fitting portion and a rib separating said main body portion and said filling portion, said main body portion including at least one through hole formed therein for receiving the fastener.

25. A steering device for a personal watercraft, comprising:

a handle holder mountable to a watercraft body, said handle holder including a holding member attached thereto by a fastener;

a steering shaft passing through said handle holder, said steering shaft including a flange; and a handle mounted to an upper end of said steering shaft, wherein said holding member is fitted on said flange of said steering shaft, whereby movement of said steering shaft in the axial direction is restricted, said holding member including a groove formed therein for receiving said flange, and wherein said flange is formed as an integral, one piece member with said steering shaft.

* * * * *